US008220683B2

(12) United States Patent
Williams

(10) Patent No.: US 8,220,683 B2
(45) Date of Patent: Jul. 17, 2012

(54) DRILL HOLDER TOOL BELT

(75) Inventor: Matthew G. Williams, Lighthouse Point, FL (US)

(73) Assignee: LF Centennial Limited, Tortola (BV)

( * ) Notice: Subject to any disclaimer, the term of this patent is extended or adjusted under 35 U.S.C. 154(b) by 704 days.

(21) Appl. No.: 11/966,071

(22) Filed: Dec. 28, 2007

(65) Prior Publication Data

US 2008/0179368 A1 Jul. 31, 2008

Related U.S. Application Data

(60) Provisional application No. 60/882,300, filed on Dec. 28, 2006.

(51) Int. Cl.
*A45F 5/00* (2006.01)
*A45F 3/00* (2006.01)

(52) U.S. Cl. ..... 224/662; 224/680; 224/684; 224/904

(58) Field of Classification Search ..... 224/660, 224/662, 681, 682, 904, 683, 684, 680; 150/112, 150/117

See application file for complete search history.

(56) References Cited

U.S. PATENT DOCUMENTS 898,372 A * 9/1908 Jennings ..... 224/681
2,477,388 A * 7/1949 Moore ..... 150/112
2,758,798 A * 8/1956 Schmidt ..... 224/245
2,857,948 A * 10/1958 Schlessinger et al. ..... 150/136
5,620,121 A * 4/1997 Watson ..... 224/272
5,988,315 A 11/1999 Crane
6,119,909 A * 9/2000 Dancyger ..... 224/683
6,152,202 A * 11/2000 Magid ..... 150/112
6,193,122 B1 2/2001 Buckley
6,283,183 B1 * 9/2001 Cooper ..... 150/112
6,390,348 B1 * 5/2002 Godshaw et al. ..... 224/674
6,446,852 B1 9/2002 Sorensen et al.
6,561,402 B2 * 5/2003 Holland et al. ..... 224/677
6,662,985 B2 * 12/2003 Harada et al. ..... 224/661
6,702,168 B2 * 3/2004 Panosian ..... 224/583
6,712,251 B2 3/2004 Godshaw et al.
6,799,500 B1 * 10/2004 Kulikowski ..... 89/34
6,923,357 B2 * 8/2005 Smith ..... 224/605
2003/0173391 A1 * 9/2003 Girbert ..... 224/625
2005/0133561 A1 * 6/2005 Kimball ..... 224/674
2008/0017683 A1 * 1/2008 Votel ..... 224/677

* cited by examiner

*Primary Examiner* — Justin Larson
*Assistant Examiner* — Adam Waggenspack
(74) *Attorney, Agent, or Firm* — Duane Morris LLP; J. Rodman Steele; Gregory M. Lefkowitz

(57) ABSTRACT

A tool belt including an inner tool receiving chamber positioned inside of an outer accessory pocket and configured to releasably contain a tool, such as a handheld drill, in an easily accessible position proximate to a user's hip. The tool belt may be configured such that the outer accessory pocket is capable of maintaining an opening of the outer accessory pocket open to permit easy access to items, such as nails, screws, and other connectors, contained in the pocket. The tool belt may also include an orifice in a bottom wall in the inner tool receiving chamber enabling a portion of a tool, such as a drill bit and a portion of a chuck drive assembly of a drill.

19 Claims, 7 Drawing Sheets

DRILL HOLDER TOOL BELT

CROSS REFERENCE TO RELATED APPLICATION

This application claims the benefit of U.S. Provisional Application No. 60/882,300, filed Dec. 28, 2006.

FIELD OF THE INVENTION

This invention is directed generally to tool belts, and more particularly to tool belts configured to support handheld drills.

SUMMARY OF THE INVENTION

This invention is directed to a tool belt configured to support connectors and one or more tools in a position that facilitates easy removal of the tool with a single hand of a user and easy access to the connectors. In particular, the tool belt may be configured to support a tool, such as, but not limited to, a handheld drill, in an inner tool receiving chamber positioned inside of an outer accessory pocket. The outer accessory pocket may be configured such that an opening of the outer accessory pocket remains opened to permit easy access to items, such as nails, screws, and other connectors, contained in the outer accessory pocket. The outer accessory pocket may releasably contain a tool, such as a handheld drill, in an easily accessible position proximate to a user's hip. The tool belt may also include an orifice in a bottom wall in the inner tool receiving chamber enabling a portion of a tool, such as a drill bit and a portion of a chuck drive assembly of a drill, to extend through the bottom wall.

The tool belt may be formed from a tool belt body having at least one belt attachment device such that the tool belt body may be attached to a waist of a user. An outer accessory pocket may extend outwardly from the tool belt body, wherein the accessory pocket may form a pocket capable of containing items and having an upwardly faced opening enabling items in the pocket to be accessed from above. The outer accessory pocket may be formed from a material enabling the opening of the outer accessory pocket to remain open. The outer accessory pocket may be formed from an outer wall extending from the tool belt body, a bottom wall extending from the tool belt body to the outer wall and a pocket wall extending from an edge of the opening of the outer accessory pocket toward the bottom wall and back towards the opening of the inner tool receiving chamber, terminating at an outer edge of the opening for the inner tool receiving chamber. The pocket wall may form a bottom that is positioned closer to the opening of the outer accessory pocket than the bottom wall forming the outer accessory pocket. The bottom of the pocket wall may be separated from the bottom wall forming the outer accessory pocket. The outer accessory pocket may have a generally semicircular shaped opening.

An inner tool receiving chamber may be positioned inside of the outer accessory pocket and may have an opening at a substantially same end of the tool belt body as the opening in the outer accessory pocket. The inner tool receiving chamber may be formed from a material enabling the opening of the inner tool receiving chamber to remain open. The inner tool receiving chamber may be configured to releasably contain a tool. An end of the inner tool receiving chamber opposite to the upwardly faced opening may be open, and at least one orifice in a bottom wall forming the inner tool receiving chamber may be aligned with the opening in the inner tool receiving chamber enabling a portion of a tool inserted into the inner tool receiving chamber to extend therethrough and in the bottom wall of the outer accessory pocket. In one embodiment, the at least one orifice may have a diameter that is less than a cross-sectional area of the inner tool receiving chamber.

A restraint device may be configured to prevent a tool positioned in the inner tool receiving chamber from being removed from the inner tool receiving chamber. In one embodiment, the restraint device may be a strap attached to the tool belt body and have a sufficient length to extend across the opening of the inner tool receiving chamber and be releasably attached to a wall forming the inner tool receiving chamber.

The tool belt may include at least one accessory pocket attached to an outer surface of the outer accessory pocket and sized smaller than the outer accessory pocket. The at least one accessory pocket comprises a plurality of accessory pockets extending from an outer surface of the outer accessory pocket. The tool belt may also include padding positioned on a surface of the tool belt body that is opposite to a side of the tool belt body to which the outer accessory pocket is attached.

An advantage of this invention is that the inner tool receiving chamber may be positioned concentrically within the outer accessory pocket, thereby enabling a tool to be stored in a readily available position facilitating easy access to the tool.

Another advantage of this invention is that the tool may be positioned in close proximity to connectors stored in the outer accessory pocket which makes it very easy for a worker to remove a tool and attach a connector, such as a screw, to the tool via a magnet with a single hand.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 4:
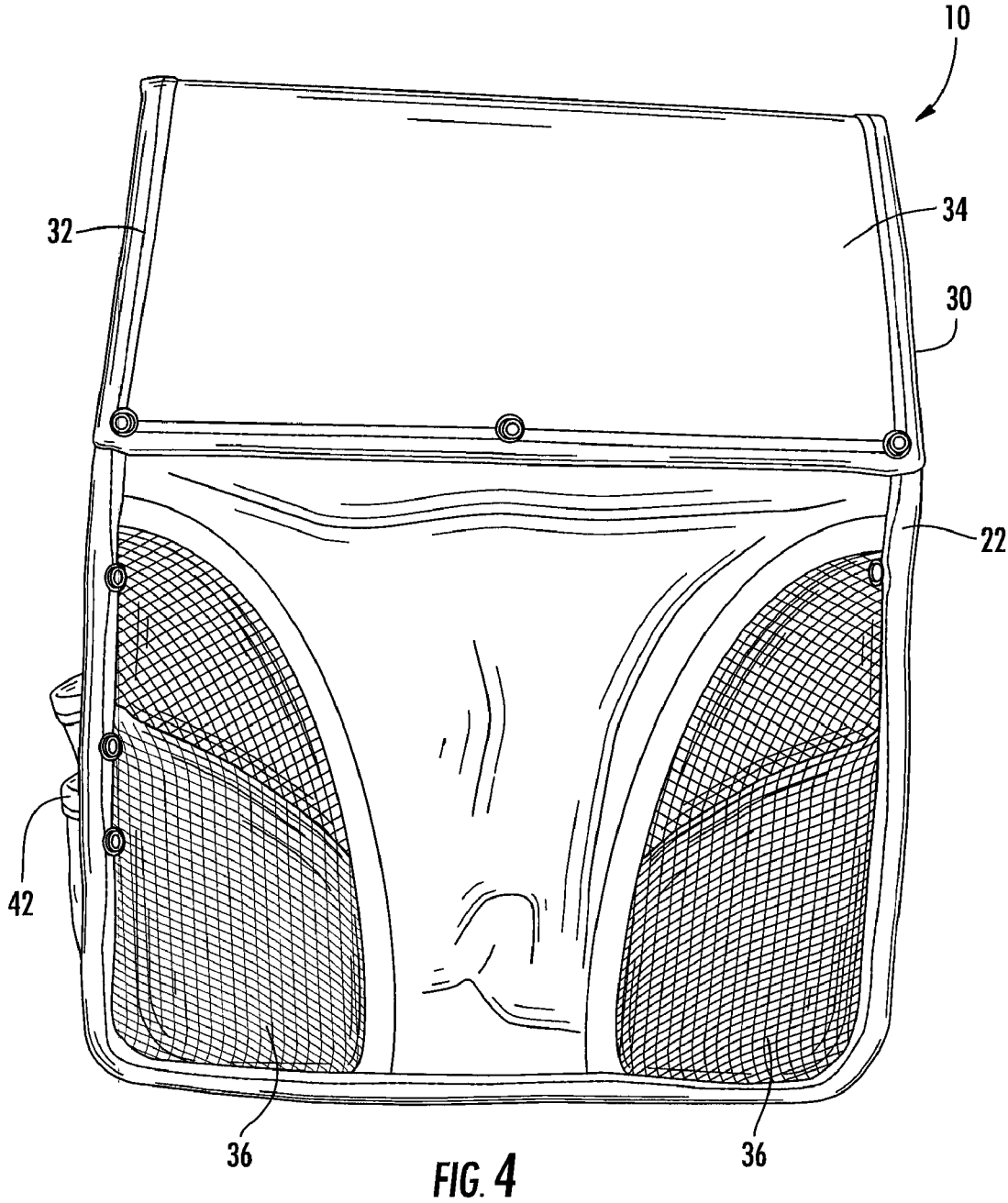
FIG. 4 is a rear view of the tool belt.
Figure 5:
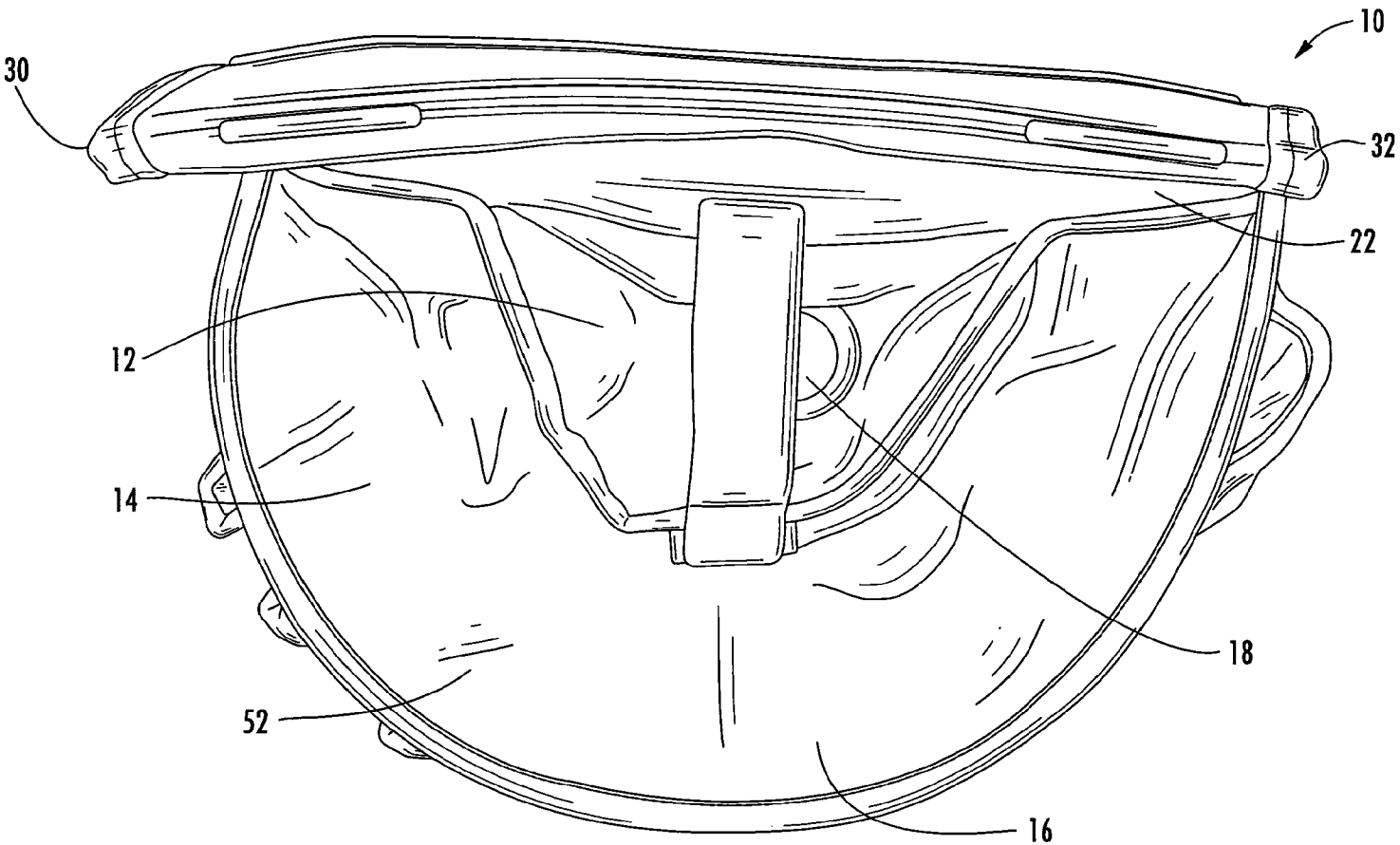
FIG. 5 is a top view of the tool belt.
Figure 6:
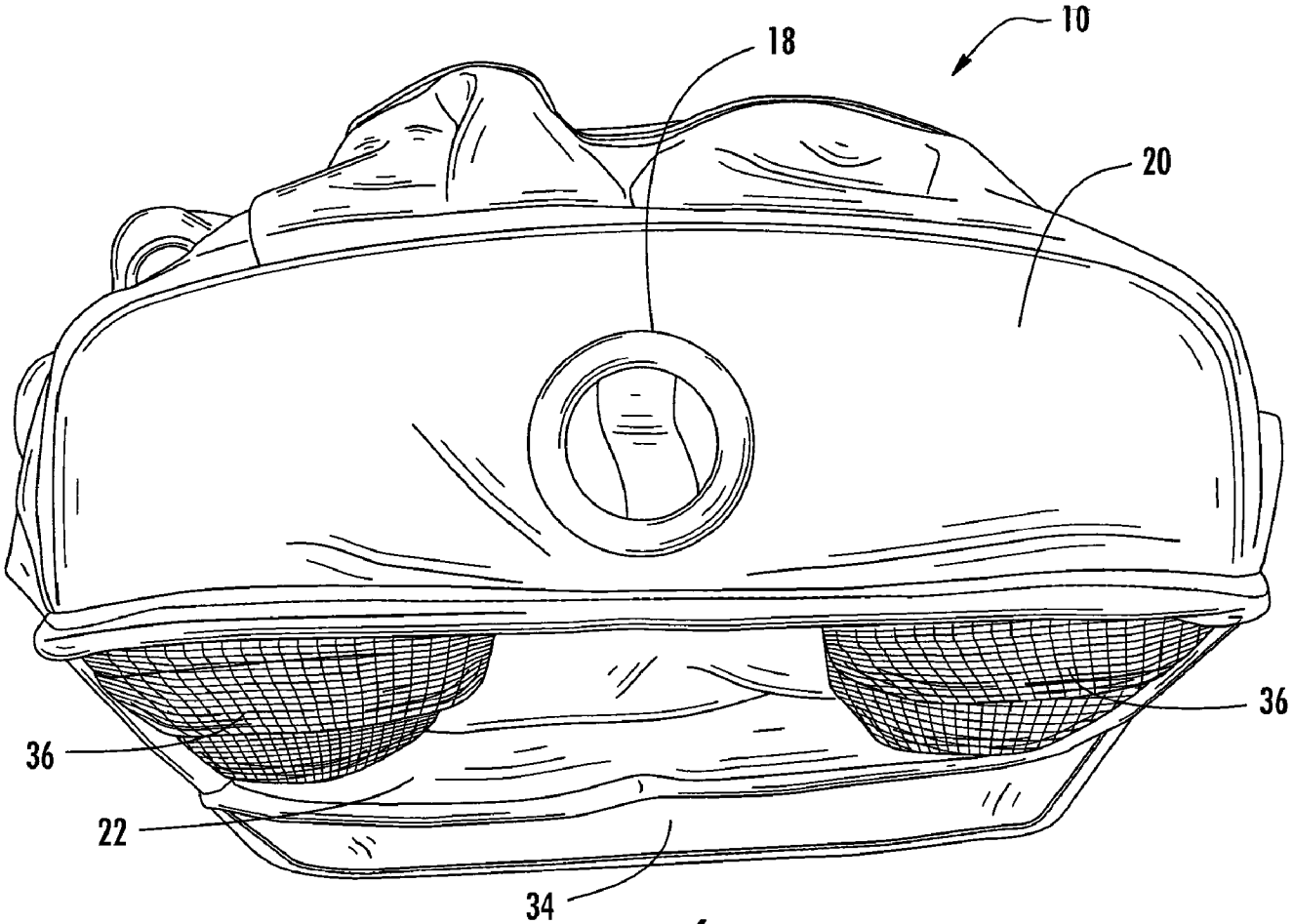
FIG. 6 is a bottom view of the tool belt.

As shown in FIGS. 1-7, this invention is directed to a tool belt 10 configured to support connectors and one or more tools in a position that facilitates easy removal of the tool with a single hand of a user and easy access to the connectors. In particular, the tool belt 10 may be configured to support a tool, such as, but not limited to, a handheld drill, in an inner tool receiving chamber 12 positioned inside of an outer accessory pocket 14. The outer accessory pocket 14 may be configured such that an opening 16 of the outer accessory pocket 14 remains opened to permit easy access to items, such as nails, screws, and other connectors, contained in the outer accessory pocket 14. The outer accessory pocket 14 may releasably contain a tool, such as a handheld drill, in an easily accessible position proximate to a user's hip. As shown in FIG. 6, the tool belt 10 may also include an orifice 18 in a bottom wall 20 in the inner tool receiving chamber 12 enabling a portion of a tool, such as a drill bit and a portion of a chuck drive assembly of a drill, to extend through the bottom wall 20.

Figure 1:
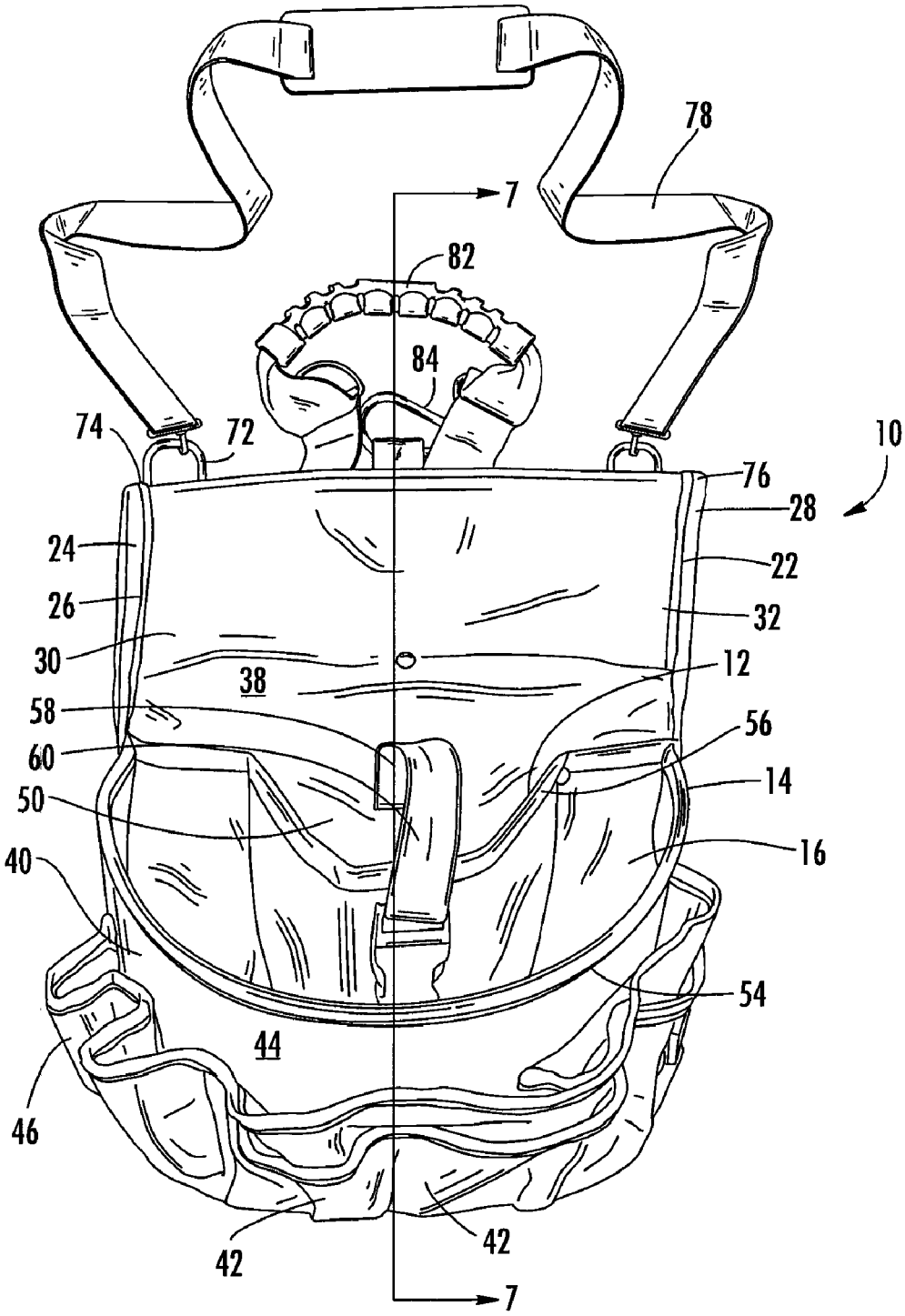
FIG. 1 is a perspective view of a tool belt with aspects of the invention.
Figure 2:
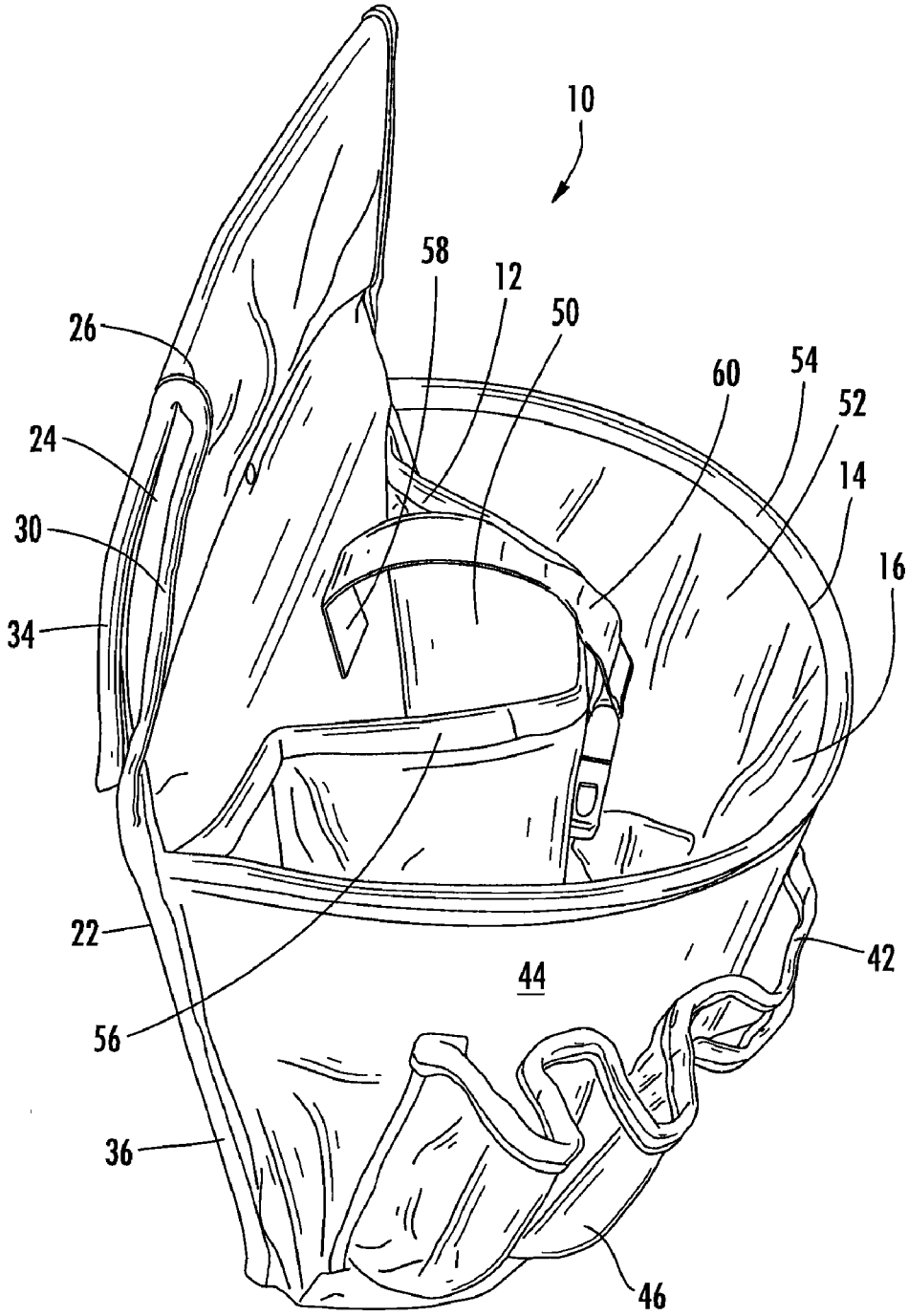
FIG. 2 is a left side view of the tool belt.
Figure 3:
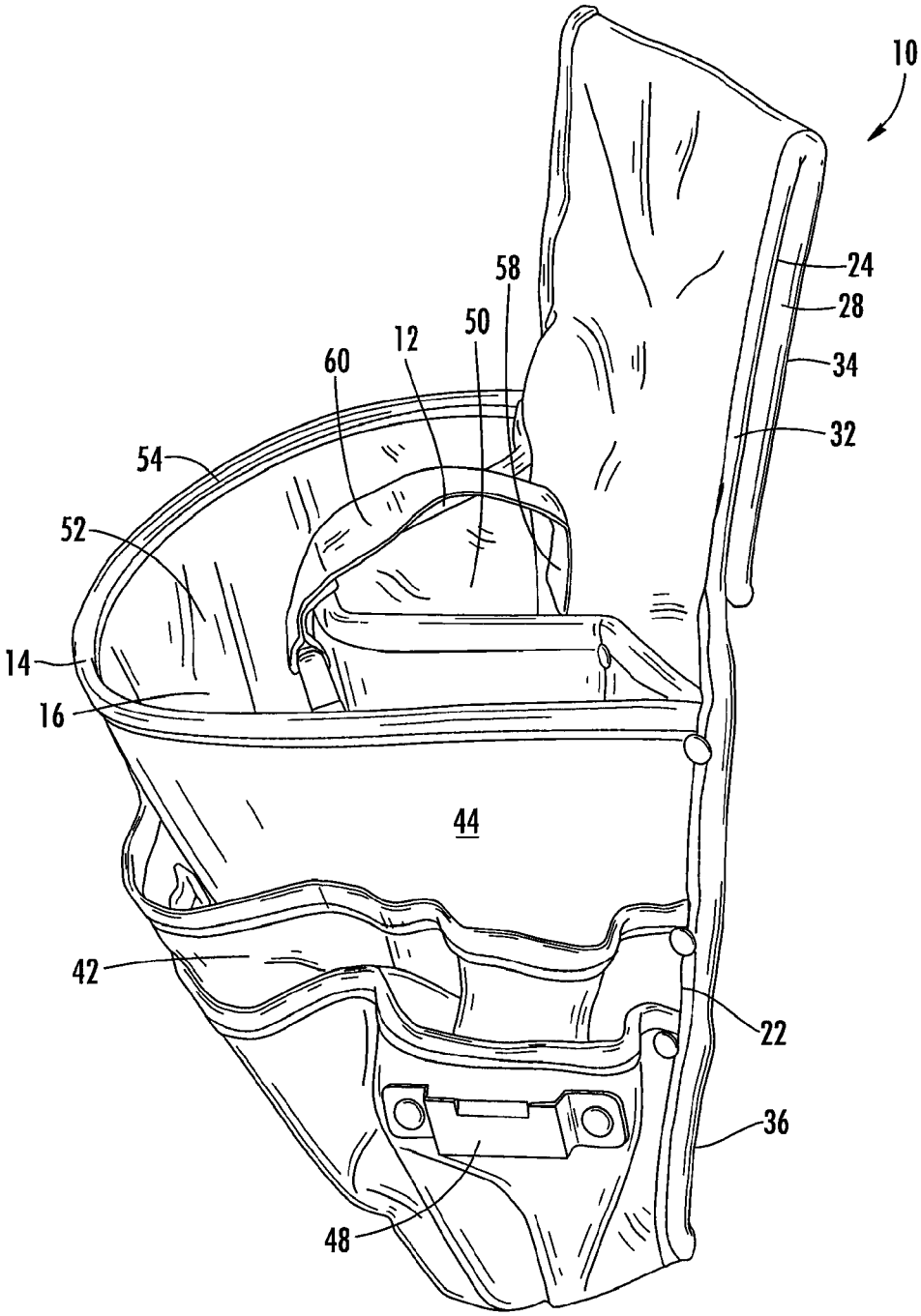
FIG. 3 is a right side view of the tool belt.

The tool belt 10 may include a tool belt body 22. As shown in FIGS. 1-3, the tool belt body 22 may be a formed from a generally planar member. The tool belt body 22 may be formed with one or more layers of a fabric. For instance, the tool belt 10 may be formed from a durable fabric such as, but not limited to, CORDURA, SPUNTUFF, and other appropriate fabrics. As shown in FIGS. 1 and 5, the tool belt body 22 may also include a belt attachment device 24, such as a belt receiving chamber 24, proximate to an upper end of the tool belt body 22 for receiving a belt to attach the tool belt 10 to a user's waist. The belt receiving chamber 24 may include openings 26, 28 at a first side edge 30 and a second side edge 32, respectively. The belt receiving chamber 24 may be formed from one or more layers of a fabric. The belt receiving chamber 24 may be formed by folding the fabric forming the tool belt body 22 at the top of the tool belt body 22 back onto itself and attaching thereto. The fabric may be attached with rivets, stitching or other appropriate connection device. Such a configuration forms an outer wall 34 of the belt receiving chamber 24. One or more support members may be included in the belt receiving chamber 24 for enhancing the strength of the belt receiving chamber 24. The support members may be formed from materials, such as, but not limited to, a polyethylene (PE) board, such as, but not limited to, a high density polyethylene (HDPE). The support members may be included within the fabric in the outer wall 34 forming the belt receiving chamber 24. In one embodiment, a single support member may be included in the belt receiving chamber 24.

As shown in FIG. 4, the tool belt 10 may include padding 36 on the tool belt body 22 for reducing discomfort to a user caused by the weight of the contents contained by the tool belt 10. The padding 36 may be attached to a surface of the tool belt body 22 opposite to the outer accessory pocket 14. The padding 36 may positioned on the bottom corners of the generally rectangular tool belt body 22 and separated from each other such that the tool belt body may rest comfortably on a leg of a user. The padding 36 may be any appropriate padding. In at least one embodiment, the padding 36 may be between about ⅜ inch and about ¾ inch in thickness.

As shown in FIGS. 1-3, the outer accessory pocket 14 may extend outwardly from a front surface 38 of the tool belt body 22. The outer accessory pocket 14 may be attached to tool belt body 22 and may form a bottom wall 20 and a side wall 40 and may include an opening 16 positioned opposite from the bottom wall 20. The outer accessory pocket 14 may be formed from a durable fabric such as, but not limited to, CORDURA, SPUNTUFF, and other appropriate fabrics. The fabric may be supported by materials, such as, but not limited to, a PE board, such as, but not limited to, a HDPE board, so that the opening 16 remains open without other assistance. The outer accessory pocket 14 may have a generally semicircular shaped opening 16.

One or more accessory pockets 42 may be attached to an outer surface 44 of the side wall 40 of the outer accessory pocket 14. The accessory pockets 42 may be formed from the same fabric used to form the tool belt body 22 and the outer accessory pocket 14, or may be formed from other appropriate materials. The accessory pockets 42 may be attached with stitches, rivets or other appropriate connection devices. In one embodiment, the tool belt 10 may include three accessory pockets 42 formed from a single piece of fabric and another three accessory pockets 42 formed from a single piece of fabric attached to an outer surface of the first three accessory pockets. Both sets of three accessory pockets 42 may be aligned with each other. The tool belt 10 may also include one or more specialized tool pockets 46 positioned adjacent to the accessory pockets 42. The tool belt 10 may also include a tape holder 48 for releasably supporting a conventional cylindrically wound tape measure.

Figure 7:
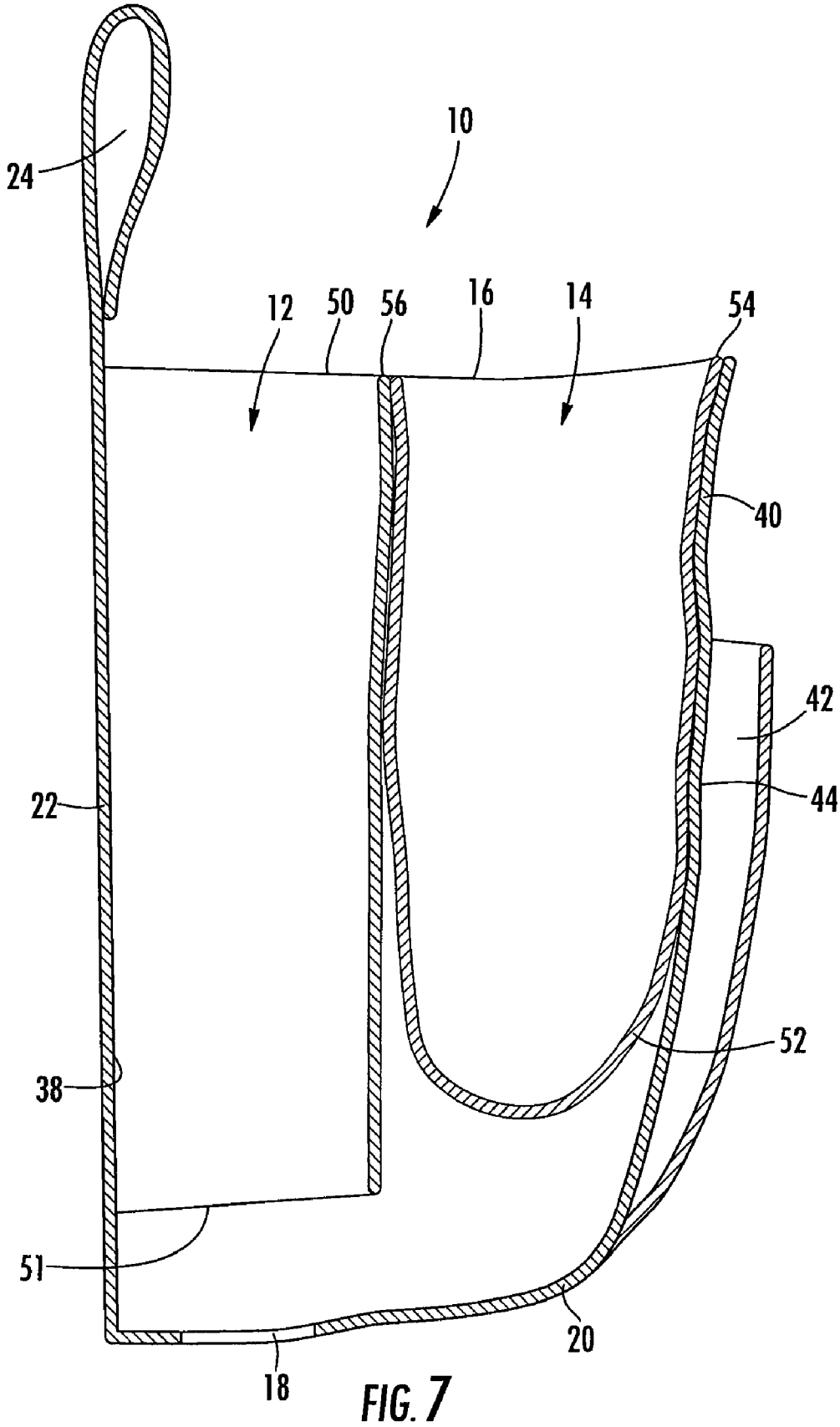
FIG. 7 is a cross-sectional view taken along section line 7-7 in FIG. 1.

The tool belt 10 may be configured such that the inner tool receiving chamber 12 is positioned within the outer accessory pocket 14. The inner tool receiving chamber 12 may have any appropriate shape. In at least one embodiment, the inner tool receiving chamber 12 may have a relatively semicircular shaped opening 50. The inner tool receiving chamber 12 may be formed from a material enabling the inner tool receiving chamber 12 to stay open without other assistance. The inner tool receiving chamber 12 may extend from proximate to the bottom wall 20 to the opening 50. As shown in FIG. 7, the opening 50 may be generally aligned in height with the opening 16 of the outer accessory pocket 14. The inner tool receiving chamber 12 may include an opening 51 at the bottom of the inner tool receiving chamber 12 generally opposite to the opening 50.

An orifice 18 may be positioned in the bottom wall 12 of the outer accessory pocket 14. As shown in FIG. 7, the orifice 18 may be aligned with the opening 51 at the bottom of the inner tool receiving chamber 12. The orifice 18 may have a diameter less than a cross-sectional area of the inner tool receiving chamber 12 and be sized to receive a portion of a tool, such as a portion of a handheld drill. In particular, the orifice 18 may be sized to receive a drill bit and a portion of a chuck drive assembly. In such an embodiment, the drill bit may protrude through the orifice 18 and allow the handle of the drill to rest on the upper edges of the inner tool receiving chamber 12 and possibly the outer accessory pocket 14, if the drill is large enough to do so.

In one embodiment, the outer accessory pocket 14 may include a pocket wall 52 forming a suspended pocket above and separated from the bottom wall 20. The pocket wall 52 may form a bottom that is positioned closer to the opening 16 of the outer accessory pocket 14 than the bottom wall 20 forming the outer accessory pocket 14. In other words, the pocket wall 52 may form a bottom above the bottom wall 20 forming the outer accessory pocket 14. The pocket wall 52 may separate the outer accessory pocket 14 from the inner tool receiving chamber 12 and prevent connectors, such as screws and the like, from dropping through the orifice 18 in the bottom wall 20. The pocket wall 52 may extend from an edge 54 of the opening 16 of the outer accessory pocket 14 toward the bottom wall 20 and turn towards and extend to the opening 50 of the inner tool receiving chamber 12. The pocket wall 52 may terminate at an outer edge 56 of the opening 50 for the inner tool receiving chamber 12. The pocket wall 52 may be formed from a single piece of material, such as one of the fabrics previously identified, and may be attached to the tool belt body 22, the inner tool receiving chamber 12, and the outer accessory pocket 14. In other embodiments, the pocket wall 52 may be formed from two pieces of material made from one or more types of material. The fabric may be stitched together where the corners of the outer accessory pocket 14 attach to the tool belt body 22. In other embodiments, the pocket wall 52 may be formed from two or more pieces of material connected together.

The tool belt 10 may also include a restraint device 58 configured to prevent a tool positioned in the inner tool receiving chamber 12 from being removed from the inner tool receiving chamber 12. In one embodiment, the restraint device 58 may be a strap 60 attached to the tool belt body 22 and may have a sufficient length to extend across the opening 50 of the inner tool receiving chamber 12. The restraint device 58 may be releasably attached to a wall forming the inner tool receiving chamber 12. The strap 60 may include a conventional quick release connector or other appropriate connector.

The tool belt 10 may be supported in many different manners. For instance, the belt receiving chamber 24 through which a belt may be inserted may enable the tool belt to be supported by a belt around the waist of a person. The tool belt 14 may also include a plurality of shoulder strap connectors 72 to attach a shoulder strap 78 to the tool belt 14. In one embodiment, the plurality of shoulder strap connectors 72 and the shoulder strap 78 may be used without the belt receiving chamber 24 being on the tool belt 10. The shoulder strap connectors 72 may be, but are not limited to, D-rings or other appropriate connectors. One shoulder strap connector 72 may be attached to a front or backside surface of an upper corner 74 of the tool belt 14. A second shoulder strap connector 72 may be attached to a front or backside surface of an upper corner 76 of the tool belt 14.

The shoulder strap 78 may be any appropriate shoulder strap. In at least one embodiment, the shoulder strap 78 may include padding and include a slide resistant outer surface to prevent the shoulder strap from sliding off of a shoulder of a person using the tool belt 14. The shoulder strap 78 may include releasable connectors, such as, but not limited to, carabineers, clips, or other releasable connectors. The tool belt 10 may also include a handle 82 attached to an upper portion of the tool belt 10. The handle 82 may be flexible and sewn at the top of the tool belt 10 along with an additional loop sewn in the middle top of the tool belt 10 to utilize a snap lock connector 84.

During use, the tool belt 10 conveniently supports a tool proximate to a hand of a user. For instance, in one embodiment, the tool belt 10 may be particularly suited for use by drywall hangers. During such use, the tool belt 10 may support a handheld drill in the inner tool receiving chamber 12 and screws, such as drywall screws, in the outer accessory pocket 14. Whenever a drywall board has been properly positioned, a user may withdraw the drill from the tool belt 10 with a single hand and withdraw a screw from the tool belt 10 using a magnetized drill bit, all single-handedly. Thus, a drywall hanger may quickly and generally in a single motion, retract the drill and screw and move into position to drill the screw into the drywall board. When the drywall hanger has finished using the drill, the drywall hanger may easily return the drill to the inner tool receiving chamber 12. These actions may be repeated hundreds of times each day by a user with ease.

The openings 16, 50 may be positioned below the waist of a person and generally at the position of a user's hand when the arm is in a relaxed position at a user's side. In this position, a user may quickly and efficiently remove a tool contained in the inner tool receiving chamber 12.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A tool belt, comprising:

a tool belt body having at least one belt attachment device such that the tool belt body may be attached to a waist of a user; and an inner tool receiving chamber positioned inside of an outer accessory pocket extending outwardly from the tool belt body, the outer accessory pocket has an upwardly faced first opening formed between an outer wall of the outer accessory pocket and the inner tool receiving chamber;

wherein the inner tool receiving chamber has an opening at substantially a same end of the tool belt body as the first opening in the outer accessory pocket, and the inner tool receiving chamber is configured to releasably contain a tool;

wherein the outer accessory pocket comprises the outer wall extending from the tool belt body, a bottom wall extending from the tool belt body to the outer wall, and a pocket wall extending from an edge of the outer wall to an outer edge of the upwardly faced opening for the inner tool receiving chamber, said pocket wall extending across an entirety of the first opening of the outer accessory pocket and forming a suspended pocket above and separated from the bottom wall, said suspended pocket being capable of containing items and having an upwardly faced opening enabling items in the pocket to be accessed from above, wherein a space is formed between said pocket wall, said bottom wall, said tool belt body and said inner tool receiving chamber, further comprising an inner opening at an end of the inner tool receiving chamber opposite to the upwardly faced opening connecting said inner tool receiving chamber to said space.

2. The tool belt of claim 1, further comprising padding positioned on a surface of the tool belt body that is opposite to a side of the tool belt body to which the outer accessory pocket is attached.

3. The tool belt of claim 1, wherein said pocket wall has a first edge and a second edge, the first, edge of the pocket wall attaches along an entire length of the edge of the outer wall, and the second edge of the pocket wall attaches along an entire length of the outer edge of the upwardly faced opening for the inner tool receiving chamber.

4. The tool belt of claim 1, wherein said tool belt further comprises at least one orifice in said outer accessory pocket opposite said upwardly faced opening, said at least one orifice being aligned with the opening in the inner tool receiving chamber enabling a portion of a tool inserted into the inner tool receiving chamber to extend therethrough and said at least one orifice of the outer accessory pocket.

5. The tool belt of claim 4, wherein the at least one orifice has a cross-sectional area that is less than a cross-sectional area of the inner tool receiving chamber.

6. The tool belt of claim 1, wherein the pocket wall forms a bottom that is positioned closer to the opening of the outer accessory pocket than the bottom wall forming the outer accessory pocket.

7. The tool belt of claim 6, wherein the bottom of the pocket wall is separated from the bottom wall forming the outer accessory pocket.

8. The tool belt of claim 1, further comprising a restraint device configured to prevent a tool positioned in the inner tool receiving chamber from being removed from the inner tool receiving chamber.

9. The tool belt of claim 8, wherein the restraint device is a strap attached to the tool belt body and having a sufficient length to extend across the opening of the inner tool receiving chamber and be releasably attached to a wall forming the inner tool receiving chamber.

10. The tool belt of claim 1, further comprising at least one accessory pocket attached to an outer surface of the outer accessory pocket and sized smaller than the outer accessory pocket.

11. The tool belt of claim 10, wherein the at least one accessory pocket comprises a plurality of accessory pockets extending from an outer surface of the outer accessory pocket.

12. The tool belt of claim 1, wherein the outer accessory pocket is formed from a material enabling the opening of the outer accessory pocket to remain open.

13. The tool belt of claim 12, wherein the inner tool receiving chamber is formed from a material enabling the opening of the inner tool receiving chamber to remain open.

14. The tool belt of claim 13, wherein the outer accessory pocket has a generally semicircular shaped opening.

15. A tool belt, comprising:

a tool belt body having at least one belt attachment device such that the tool belt body may be attached to a waist of a user; and an inner tool receiving chamber positioned inside of an outer accessory pocket extending outwardly from the tool belt body, the outer accessory pocket has an upwardly faced first opening formed between an outer wall of the outer accessory pocket and the inner tool receiving chamber and is formed from a material enabling the opening of the outer accessory pocket to remain open;

wherein the inner tool receiving chamber has an upwardly faced opening at substantially a same end of the tool belt body as the upwardly faced first opening in the outer accessory pocket and is formed from a material enabling the upwardly faced opening of the inner tool receiving chamber to remain open;

wherein the outer accessory pocket comprises the outer wall extending from the tool belt body, a bottom wall extending from the tool belt body to the outer wall and a pocket wall extending from an edge of the outer wall to an outer edge of the upwardly faced opening for the inner tool receiving chamber, said pocket wall extending across an entirety of the first opening of the outer accessory pocket and forming a suspended pocket above and separated from the bottom wall, said suspended pocket being capable of containing items and having an upwardly faced opening enabling items in the pocket to be accessed from above, wherein the pocket wall forms a bottom that is positioned closer to the upwardly faced first opening of the outer accessory pocket than the bottom wall forming the outer accessory pocket, wherein a space is formed between said pocket wall, said bottom wall, said tool belt body and said inner tool receiving chamber, further comprising an inner opening at an end of the inner tool receiving chamber opposite to the upwardly faced opening connecting said inner tool receiving chamber to said space; and wherein the inner tool receiving chamber is configured to releasably contain a tool.

16. The tool belt of claim 15, wherein an end of the inner tool receiving chamber opposite to the upwardly faced opening is open, and further comprising at least one orifice in a bottom wall forming the inner tool receiving chamber that is aligned with the opening in the inner tool receiving chamber enabling a portion of a tool inserted into the inner tool receiving chamber to extend therethrough and in the bottom wall of the outer accessory pocket.

17. The tool belt of claim 15, further comprising a restraint device configured to prevent a tool positioned in the inner tool receiving chamber from being removed from the inner tool receiving chamber; wherein the restraint device is a strap attached to the tool belt body and having a sufficient length to extend across the opening of the inner tool receiving chamber and be releasably attached to a wall forming the inner tool receiving chamber.

18. The tool belt of claim 15, further comprising at least one accessory pocket attached to an outer surface of the outer accessory pocket and sized smaller than the outer accessory pocket, and further comprising padding positioned on a surface of the tool belt body that is opposite to a side of the tool belt body to which the outer accessory pocket is attached.

19. A tool belt, comprising:

a tool belt body having at least one belt attachment device such that the tool belt body may be attached to a waist of a user; and an inner tool receiving chamber positioned inside of an outer accessory pocket extending outwardly from the tool belt body, the outer accessory pocket has an upwardly faced first opening formed between an outer wall of the outer accessory pocket and the inner tool receiving chamber and is formed from a material enabling the opening of the outer accessory pocket to remain open;

wherein the inner tool receiving chamber has an upwardly faced opening at substantially a same end of the tool belt body as the upwardly faced first opening in the outer accessory pocket and is formed from a material enabling the upwardly faced opening of the inner tool receiving chamber to remain open;

wherein the outer accessory pocket comprises the outer wall extending from the tool belt body, a bottom wall extending from the tool belt body to the outer wall and a pocket wall extending from an edge of the outer wall to an outer edge of the upwardly faced opening for the inner tool receiving chamber, said pocket wall extending across an entirety of the first opening of the outer accessory pocket and forming a suspended pocket above and separated from the bottom wall, said suspended pocket being capable of containing items and having an upwardly faced opening enabling items in the pocket to be accessed from above, wherein the pocket wall forms a bottom that is positioned closer to the upwardly faced first opening of the outer accessory pocket than the bottom wall forming the outer accessory pocket, wherein a space is formed between said pocket wall, said bottom wall, said tool belt body and said inner tool receiving chamber, further comprising an inner opening at an end of the inner tool receiving chamber opposite to the upwardly faced opening connecting said inner tool receiving chamber to said space;

wherein the inner tool receiving chamber is configured to releasably contain a tool in that an end of the inner tool receiving chamber opposite to the upwardly faced opening is open, and further comprising at least one orifice in a bottom wall forming the inner tool receiving chamber that is aligned with the opening in the inner tool receiving chamber enabling a portion of a tool inserted into the inner tool receiving chamber to extend therethrough and in the bottom wall of the outer accessory pocket.

* * * * *